US008342351B2

(12) United States Patent
Hobbs, Sr.

(10) Patent No.: US 8,342,351 B2
(45) Date of Patent: Jan. 1, 2013

(54) CAP FOR CAULKING CARTRIDGE OR SIMILAR CONTAINER

(75) Inventor: Terry J. Hobbs, Sr., Rochester, IN (US)

(73) Assignee: Terry J. Hobbs, Sr., Rochester, IN (US)

( * ) Notice: Subject to any disclaimer, the term of this patent is extended or adjusted under 35 U.S.C. 154(b) by 1457 days.

(21) Appl. No.: 11/833,715

(22) Filed: Aug. 3, 2007

(65) Prior Publication Data

US 2009/0032536 A1 Feb. 5, 2009

(51) Int. Cl.
*B65D 47/00* (2006.01)
*B67D 3/00* (2006.01)

(52) U.S. Cl. ..... 220/212.5; 220/805; 220/254.9; 220/254.1; 222/151; 222/546

(58) Field of Classification Search ..... 220/254.1, 220/254.7, 709, 805, 212, 212.5, 804, 801, 220/803; 215/305, 355, 364; 222/546, 148–151; 411/80.1; 15/104.165; 206/223; 49/95
See application file for complete search history.

(56) References Cited

U.S. PATENT DOCUMENTS

| | | | | | |
|---|---|---|---|---|---|
| 152,980 | A | | 7/1874 | Donkin | |
| 193,760 | A | | 7/1877 | Hauck | |
| 601,394 | A | * | 3/1898 | Breyer, Jr. | 4/293 |
| 771,984 | A | | 10/1904 | Humphrey | |
| 1,064,544 | A | * | 6/1913 | Rosenfield et al. | 215/364 |
| 1,137,086 | A | | 4/1915 | Rodiger | |
| 1,138,764 | A | * | 5/1915 | Kline | 215/358 |
| 1,740,287 | A | | 12/1929 | Davis | |
| 1,991,523 | A | | 2/1935 | Robinson | |
| 2,035,004 | A | | 3/1936 | Van Ness | |
| 2,432,288 | A | | 12/1947 | Danziger | |
| 2,677,482 | A | | 5/1954 | Lehmann | |
| 2,731,053 | A | | 1/1956 | Lockhart | |
| 2,754,033 | A | | 7/1956 | Etter | |
| 2,849,739 | A | | 9/1958 | Dresden | |
| 2,887,240 | A | | 5/1959 | Deussen | |
| 2,969,887 | A | | 1/1961 | Darmstadt et al. | |
| 2,996,225 | A | | 8/1961 | Pike | |
| 3,044,340 | A | * | 7/1962 | Luhm | 411/80.1 |
| 3,192,555 | A | | 7/1965 | Nyden | |
| 3,193,146 | A | | 7/1965 | Isgriggs et al. | |
| 3,200,984 | A | * | 8/1965 | Fueslein et al. | 220/240 |
| 3,282,478 | A | | 11/1966 | Russell | |
| 3,482,482 | A | * | 12/1969 | Le Sage | 411/80.1 |
| 3,486,503 | A | | 12/1969 | Porter et al. | |
| 3,858,739 | A | | 1/1975 | Turner et al. | |
| 3,930,599 | A | | 1/1976 | Brothers et al. | |
| 3,961,731 | A | | 6/1976 | Mochida | |
| 3,986,429 | A | * | 10/1976 | Busler | 411/80.1 |
| 4,074,828 | A | * | 2/1978 | Haines et al. | 220/254.1 |
| 4,150,768 | A | | 4/1979 | Maynard, Jr. | |
| 4,213,546 | A | | 7/1980 | Massey | |
| 4,220,811 | A | | 9/1980 | Scott | |
| 4,248,246 | A | | 2/1981 | Ikeda | |
| 4,284,213 | A | | 8/1981 | Lee | |

(Continued)

*Primary Examiner* — Anthony Stashick
*Assistant Examiner* — James N Smalley
(74) *Attorney, Agent, or Firm* — Faegre Baker Daniels LLP

(57) ABSTRACT

A cap adapted for sealing a caulking cartridge. The cap may include a first member and a second member. The first member may have the shape of a frustum. The second member may be longer than the first member and extend through the first member. The second member may include an elongated portion, a planar member and a ring portion. The elongated portion may include a plurality of shoulders.

8 Claims, 3 Drawing Sheets

U.S. PATENT DOCUMENTS 4,345,704 A 8/1982 Boughton
4,408,699 A 10/1983 Stock
4,411,625 A 10/1983 Koblitz et al.
4,420,076 A * 12/1983 Beveridge et al. ..... 206/37
4,437,283 A 3/1984 Benoit
4,465,117 A 8/1984 Mason
4,486,179 A 12/1984 Brauer et al.
4,491,453 A 1/1985 Koblitz et al.
4,550,674 A 11/1985 Zatek
4,553,940 A 11/1985 Koblitz et al.
4,589,569 A * 5/1986 Clements ..... 220/380
4,635,823 A 1/1987 Stull
4,640,434 A * 2/1987 Johnsen et al. ..... 220/287
4,669,635 A * 6/1987 Brookhart ..... 222/151
4,790,088 A 12/1988 Morvant
5,004,128 A 4/1991 Richichi et al.
5,023,402 A 6/1991 King, Jr. et al.
5,029,738 A 7/1991 Dillon
5,053,496 A 10/1991 Bertsch et al.
5,065,913 A 11/1991 Glasener
5,071,019 A * 12/1991 Sizemore ..... 220/709
5,104,013 A 4/1992 Hawley
5,107,077 A 4/1992 Fox et al.
5,113,037 A 5/1992 King, Jr. et al.
5,140,068 A 8/1992 Siebert et al.
5,154,327 A 10/1992 Long
5,211,506 A 5/1993 Manion
5,221,016 A * 6/1993 Karpal ..... 215/12.2
5,248,071 A 9/1993 Ray
5,280,068 A 1/1994 Siebert et al.
5,295,601 A 3/1994 Bostelman
5,297,599 A * 3/1994 Bucheli ..... 141/329
5,301,843 A 4/1994 Groene et al.
5,308,890 A 5/1994 Snyder
5,356,504 A 10/1994 Maurice
5,370,271 A 12/1994 Segatz
5,379,927 A 1/1995 Montenieri et al.
5,464,888 A 11/1995 Owen
5,476,889 A 12/1995 Owen
5,480,064 A 1/1996 Yan
5,494,947 A 2/1996 Kaplan
5,560,478 A 10/1996 Moore
5,577,357 A 11/1996 Civelli
5,624,714 A 4/1997 Gaveske
5,636,757 A * 6/1997 Porvaznik ..... 215/364
5,732,520 A 3/1998 Maietta
5,799,829 A 9/1998 Lier et al.
5,833,099 A 11/1998 Boaz et al.
5,833,458 A 11/1998 Harrisson, III
D407,016 S * 3/1999 Nastasia ..... D9/439
5,894,596 A 4/1999 Hayes, Jr.
5,897,009 A 4/1999 O'Meara
5,980,495 A 11/1999 Heinz et al.
6,004,113 A 12/1999 Vay
6,022,504 A 2/2000 Boaz et al.
6,025,559 A 2/2000 Simmons
6,049,919 A 4/2000 Roteman
6,120,717 A 9/2000 Hsu et al.
6,162,938 A 12/2000 Hansen et al.
6,213,349 B1 4/2001 Yan
6,223,957 B1 5/2001 Hoppe
6,375,051 B1 4/2002 Iverson
6,380,316 B1 4/2002 Bahadur et al.
6,406,748 B2 6/2002 Held, III et al.
6,440,573 B1 8/2002 Hansen et al.
6,485,474 B1 11/2002 Heinz et al.
6,516,580 B1 2/2003 Maietta
6,787,629 B2 9/2004 Jia et al.
6,824,026 B1 11/2004 Boutwell
7,001,949 B2 2/2006 Fasano et al.
7,029,037 B2 4/2006 Poole
7,032,790 B2 4/2006 Williamson, IV et al.
2001/0048198 A1 12/2001 Dulin
2003/0127472 A1 7/2003 Doherty et al.
2005/0236441 A1 10/2005 Martin
2007/0023442 A1 * 2/2007 Auzenne ..... 220/801

* cited by examiner

CAP FOR CAULKING CARTRIDGE OR SIMILAR CONTAINER

BACKGROUND

1. Field of the Invention

The present invention relates to the field of caulking. Specifically, the invention relates to a cap for sealing a traditional caulking cartridge or similar container that includes a dispensing tube or spout.

2. Description of the Related Art

Caps configured to seal various apparatus are known in the art. For example, U.S. Pat. No. 2,754,033 teaches an ink dispenser that includes a cap. Specifically, the ink dispenser includes a spout with a base portion comprising a convex flange. The spout further includes a discharge end configured for the discharging ink. The patent teaches that the dispenser may include a cup-shaped cover which may be frictionally attached to the spout when the dispenser is not in use.

U.S. Pat. No. 2,849,739 teaches a seal for nitrocellulose cement. The patent discloses a cap configured to seal an opening in a tip of a container containing nitrocellulose cement. The cap includes a handle having the form of a disc comprising externally knurled edges. The cap further includes a closure plug that extends transversely from the middle of the handle. The closure plug is sized and configured to fill the opening formed in the tip of the container. The plug may include a tapered end and an intermediate elongated tapered or conical side wall. The side wall may have a diameter less than the opening formed within the tip of the container. Thus, the tapered portion may be pressed into the opening formed within the tip while preventing the handle from engaging the end of the tip.

Caps for sealing caulking cartridges are also known in the art. For example, U.S. Pat. No. 5,154,327 teaches a sealable nozzle adaptor for use with a caulking cartridge. The sealable nozzle adaptor includes a nozzle portion, a base, a cap and an elongated pin. The base includes a flexible skirt portion configured to engage the leading end of the cartridge. The cap is configured to close and seal the open end of the nozzle. The elongated pin is sized and configured to be secured within the cap. In addition, the elongated pin may extend into the nozzle portion of the nozzle adaptor. The cap may be attached to the base with a flexible member in order to prevent the loss of the cap. The sealable nozzle adaptor may slide over the leading edge of a caulking cartridge in order to prevent air from leaking into the cartridge.

U.S. Pat. No. 5,295,601 teaches a caulk cartridge cap. The cap is designed to allow for the storage and usage of unused caulk stored within the caulk cartridge after the cartridge has been opened. The cap closes the opening in the caulk cartridge in order to prevent the premature drying of caulk remaining in the cartridge. In addition, the cap prevents the material stored within the cartridge from blocking the cartridge tube. The cap may include a retention rod and a self threading insert. The retention rod may be sized to fit within the tube and the self threading insert may be used to attach the cap to the tube. In embodiments of the invention, the cap includes a tether, a scraping edge formed on the retention rod and a bracket assembly that may be mounted to a convention caulking gun. In embodiments of the invention, the cap may be attached to the bracket assembly.

U.S. Pat. No. 6,824,026 teaches a deformable resealing closure or cap for caulking cartridges. The cap is adapted to reseal the dispensing spout of a caulking cartridge. The resealing cap includes a spout receiving area that both conforms to, and seals against, the exterior surface of the spout. In sealing against the spout, the cap maintains an air tight seal in order to prevent the hardening of the material contained within the cartridge. The cap further includes tabs formed in its base. The tabs allow rotational forces to be imparted on the cap during removal of the cap from the cartridge. The interior dimensions of the cap are configured to provide for a progressive sealing against the outer surface of the spout as the cap distorts over the tapered exterior surface of the spout while engaging the same.

SUMMARY OF THE INVENTION

A cap configured to seal the end of a container having a dispensing tube that includes an opening formed in the tube may be representative of an embodiment of the invention. The cap may include a first member and a second member. The first member may include a first opening and a second opening. In addition, the second member may be configured to extend through the first opening. Furthermore, the second member may include at least one shoulder.

In embodiments of the invention, the cap may further include a planar member connected to of the second member. The planar member may be arranged substantially perpendicular to the second member.

In embodiments of the invention, the cap may further include a loop connected to the second member. In embodiments of the invention, the first opening is sized to retain the second member within the first member.

In embodiments of the invention, at least a portion of the second member may extend through the first opening of the first member. In addition, at least a portion of the second member may extend through the second opening of the first member.

In embodiments of the invention, the first member may be a frustum. In embodiments of the invention, the second member may include a plurality of shoulders. In embodiments of the invention, the second member may include at least six shoulders. In embodiments of the invention, the second member may further include a plurality of tapered portions. In addition, at least one of the tapered portions may be located proximate each of the shoulders.

Furthermore, an embodiment of the present invention may be a cap configured to provide a substantially air tight seal over an opening formed in a tube of a container. The cap may comprise a frustum and a first member. The frustum may include an interior portion, a first opening and a second opening. The interior portion may be sized and configured to receive at least a portion of the tube of the container. The member may be at least partially located within the interior portion of the frustum. In addition, the member may include a planar member. The planar member may be connected to the first member and extend substantially perpendicular to a longitudinal axis defined by the frustum.

An embodiment of the invention may be a cap configured to substantially seal an opening formed in a tube connected to a container. The cap may comprise a first member and a second member. The first member may include an interior defined by an interior surface and an opening. A portion of the interior surface may have a shape complementary to the tube. The second member may be at least partially located within the interior of the first member. In addition, the cap may further include means for providing a grip when removing the cap from the tube.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF AN EMBODIMENT OF THE INVENTION

Figure 2:
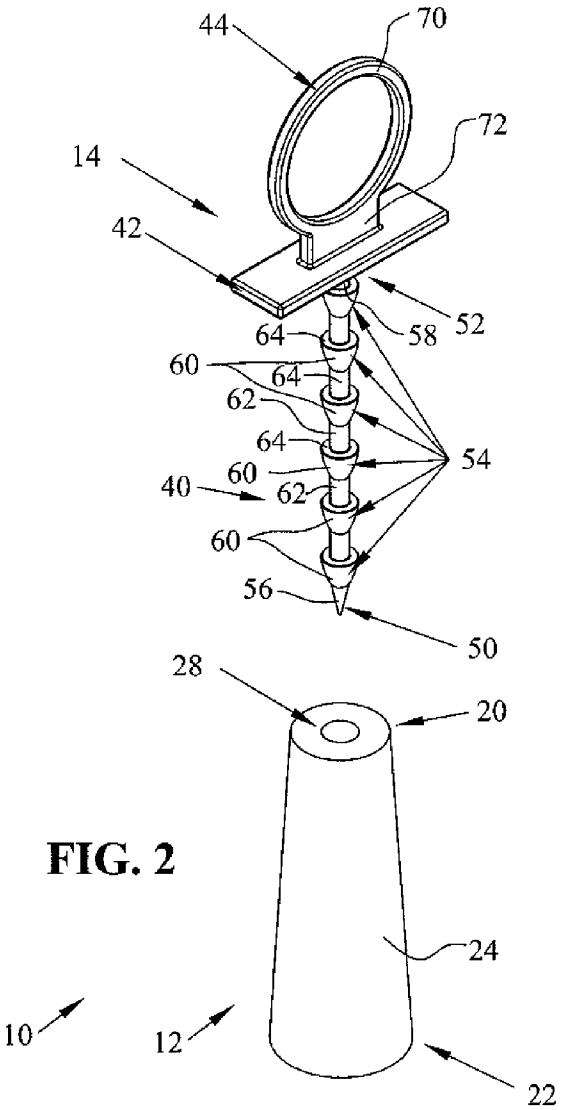
FIG. 2 is an exploded perspective view of the cap illustrated in FIG. 1.
Figure 1:
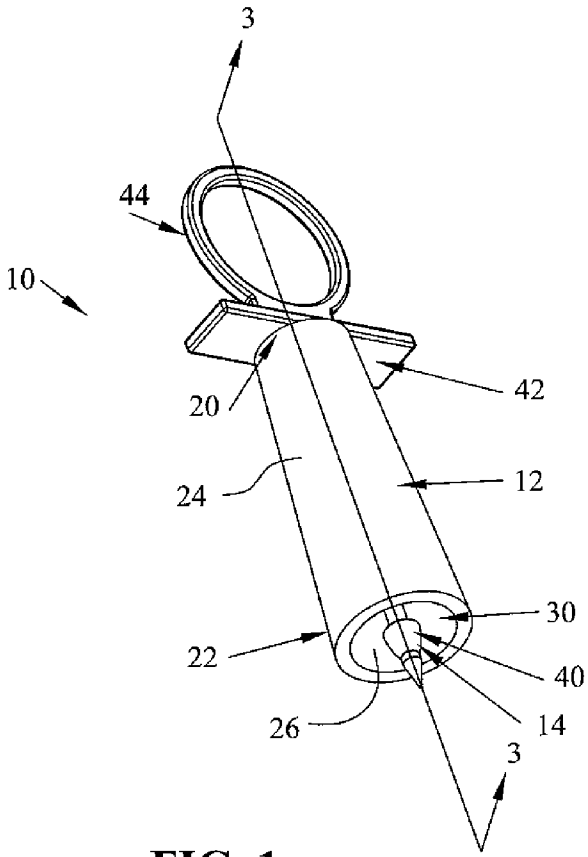
FIG. 1 is a perspective view of a cap embodying the present invention.
Figure 3:
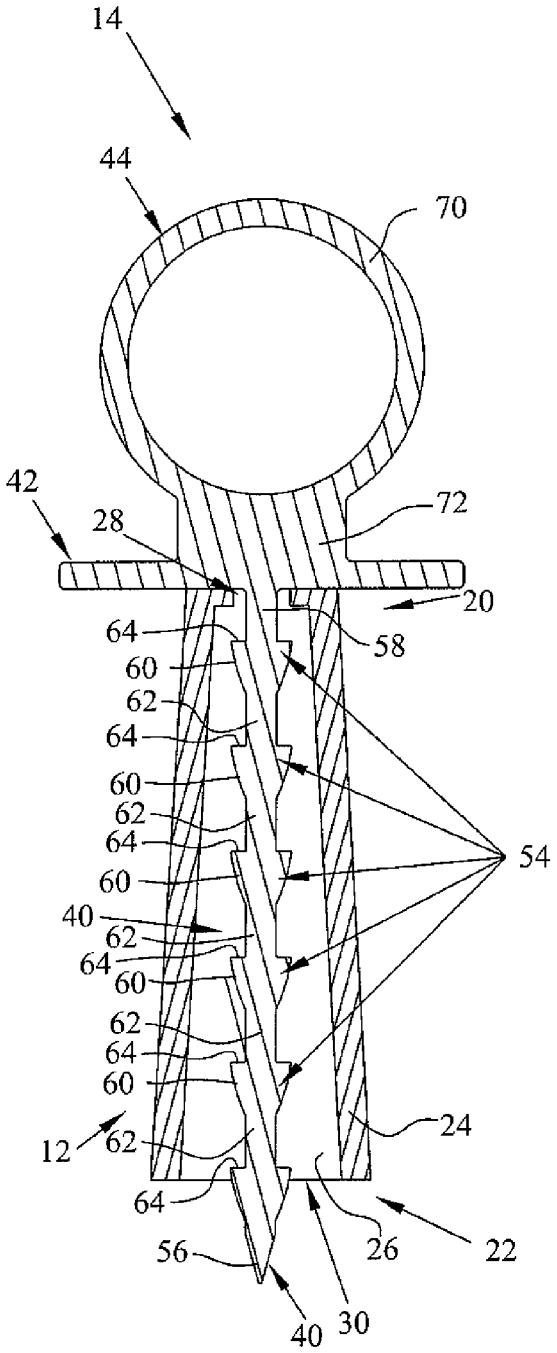
FIG. 3 is a section view of the cap illustrated in FIG. 1 taken along section line 3-3.

Referring first to FIGS. 1 through 3, one embodiment of a cap for sealing a caulking cartridge or similar container is generally indicated by numeral 10. Cap 10 may be made of any suitable material, such a plastic, and may be formed by any suitable process, such as injection molding, for example. In the depicted embodiment, a cap 10 includes a first member 12 and a second member 14.

First member 12 has the shape of a frustum and is configured to engage the dispensing tube or spout of a traditional caulking cartridge, as described below. It should be noted, however, that in other embodiments of the invention first member 12 may be shaped differently to allow the first member to engage a dispensing spout with a different configuration. First member 12 includes a first end 20, a second end 22, an outer surface 24 and an inner surface 26. The diameter of first member 12 is smaller at first end 20 than the diameter of first member 12 at second end 22. First end 20 includes an aperture 28, and second end 22 includes an aperture 30. The diameter of aperture 28 is less than the diameter of aperture 30. Outer surface 24 and inner surface 26 are both substantially smooth. Inner surface 26 defines a frustum shaped interior portion of the first member 12, generally indicated by numeral 32.

Second member 14 includes an elongated portion, generally indicated by numeral 40, a planar member 42 and a ring portion 44. Elongated portion 40 includes a first end 50, a second end 52 and a plurality of tapered sections, each generally indicated by numeral 54. First end 50 comes to a point, indicated by numeral 56, and second end 52 includes a substantially cylindrical section indicated by numeral 58.

In the depicted embodiment, the tapered sections 54 include a frustum shaped outer surface 60 and are separated by cylindrical portions 62. Other than the tapered section 54 that terminates in point 56, the diameter of each tapered section 54 closest to first end 50 is approximately equal to the diameter of cylindrical portion 62. The diameter then increases with distance from point 56. As illustrated in FIGS. 2 and 3, at the larger end, tapered sections 54 form a shoulder, indicated by numeral 64, proximate an adjacent cylindrical portion 62. It should be noted that in the depicted embodiment, elongated portion 40 has a length greater than the length of first member 12.

Referring still to FIGS. 1 through 3, planar member 42 has a substantially rectangular shape. In the depicted embodiment of the invention, planar member 42 is arranged substantially perpendicular to elongated portion 40. In addition, planar member 42 is generally positioned proximate cylindrical section 58 of second end 52 of elongated portion 40. In the depicted embodiment, elongated portion 40 and planar member 42 are integrally formed.

Ring portion 44 includes a ring 70 and a base 72. Ring 70 has a substantially circular shape, and base 72 has a substantially trapezoidal cross-section. Base 72 extends between ring 70 and planar member 42 and interconnects ring 70 to planar member 42. Note that ring 70 may take on any shape, such as an open square, that permits ring 70 to be used for gripping second member 14 and hanging cap 10, as discussed below. In the depicted embodiment, base 72 is integrally formed with ring 70 and planar member 42. It should be noted that in embodiments of the invention, base 72 may be formed separately from planar member 42 and ring 70 and attached to both in any suitable manner such as with an adhesive, for example.

As explained above, first member 12 and second member 14 may be integrally formed or formed as two separate components. If they are formed as separate components, second member 14 will need to be joined to first member 12 in any suitable manner. In the embodiment depicted, the joining of first member 12 and second member 14 may be accomplished by inserting first end 50 of second member 14 into aperture 28 of first member 12. Generally, the diameter of aperture 28 is less than the diameter of the largest ends of tapered sections 54. Accordingly, as elongated portion 40 is inserted into aperture 28, the tapered sections 54 will cause aperture 28 to experience slight elastic deformation in order to receive tapered sections 54. Once the shoulder 64 of each tapered section 54 has passed through aperture 28, however, aperture 28 will essentially return to its original size, thereby retaining the tapered section 54 within first member 12. This process may be repeated until at least a portion of cylindrical portion 58 resides within aperture 28, thereby retaining elongated portion 40 within first member 12 under normal use conditions.

Figure 6:
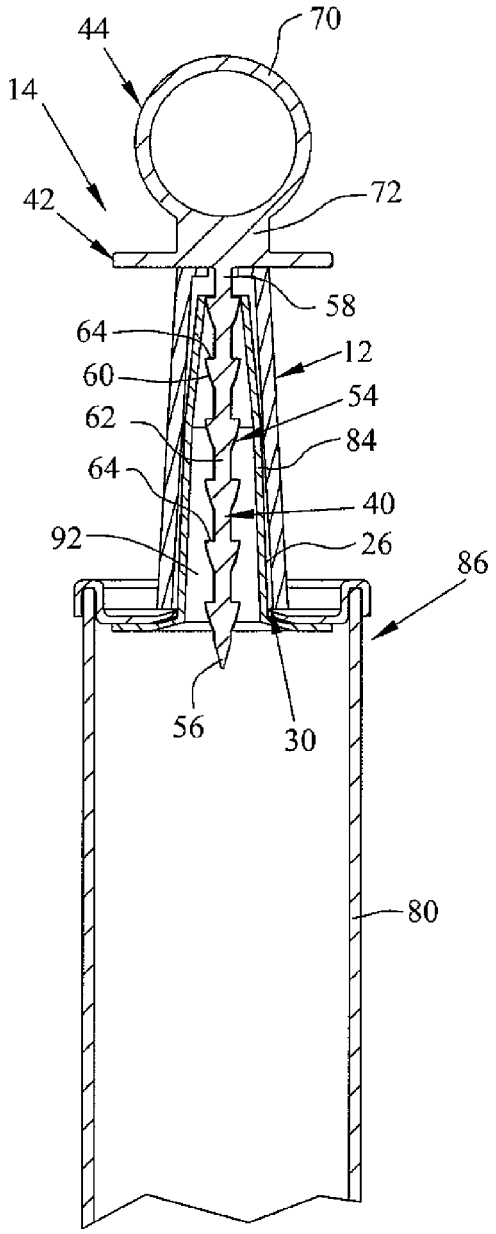
FIG. 6 is a section view of the cap and caulking cartridge illustrated in FIG. 5, taken along section line 6-6.
Figure 4:
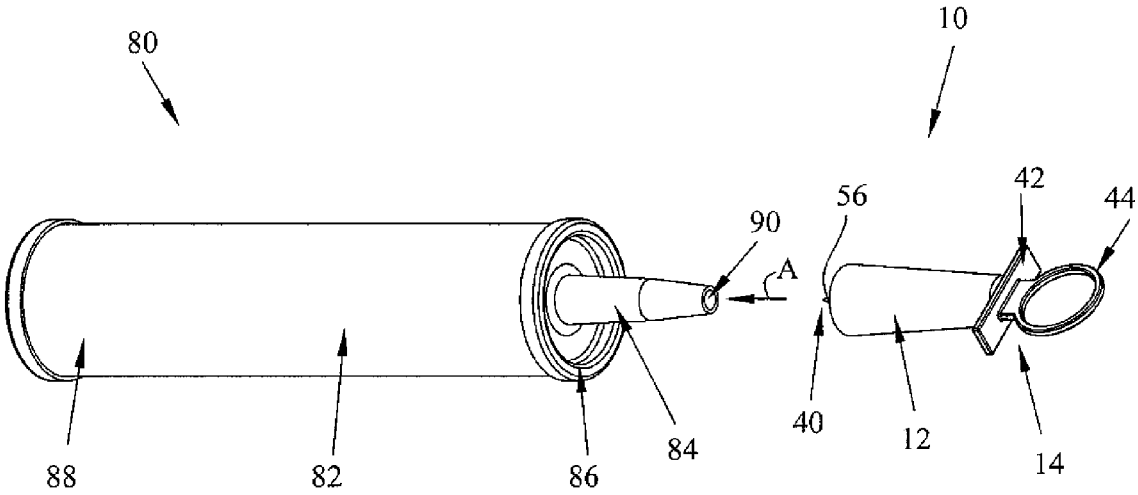
FIG. 4 is a perspective view of a cap and caulking cartridge having a dispensing tube prior to the insertion of a portion of the cap into the tube.
Figure 5:
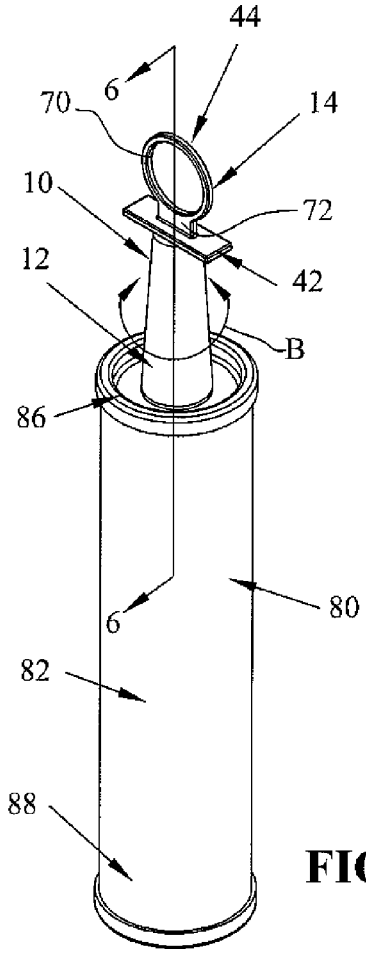
FIG. 5 is a perspective view of the cap and caulking cartridge illustrated in FIG. 4 following the insertion of at least a portion of the cap into the dispensing tube of the caulking cartridge.

The depicted embodiment of cap 10 may be used with a conventional caulking cartridge of the type illustrated in FIGS. 4 through 6 and generally indicated by numeral 80. Caulking cartridge 80 includes a container portion 82 and a dispensing spout or tube 84. Container portion 82 has a substantially cylindrical shape and includes a first end 86 and a second end 88. Tube 84 may be attached to first end 86 in any suitable manner. Tube 84 includes an opening, indicated by numeral 90. As shown in FIG. 6, tube 84 further includes a channel 92 extending from opening 90 to the first end 86 of the container portion 82. As should be understood by one with skill in the art, container portion 82 may contain various types of caulk, sealants, adhesives or other materials. As is known in the art, cartridge 80 may be configured for use with a caulking gun. Container portion 82 may include a moveable member (not shown) that will force the sealing material contained within container portion 82 through tube 84 and out opening 90 as the moveable member moves from second end 88 in the direction of first end 86.

Referring still to FIGS. 4 through 6, in the depicted embodiment, cap 10 is configured to seal opening 90 of cartridge 80. In order to seal opening 90, cap 10 is moved in the direction of arrow "A," and at least a portion of the elongated portion 40 of second member 14 is inserted into opening 90. As elongated portion 40 is inserted into opening 90, interior portion 32 of first member 12 receives at least a portion of tube 84. First member 12 may be formed from a material that is more rigid and deforms less than tube member 84. Thus, once elongated portion 40 has been fully inserted into opening 90, and at least portion of tube 84 has been received by interior portion 32, as shown in FIGS. 5 and 6, the contact between interior surface 26 and tube member 84 forms a substantially air tight seal. Note that in the embodiment depicted, elongated portion 40 has a length greater than tube 84, and cap 10 is configured such that at least a portion of elongated portion 40 will be present within the container portion 82 when cap 10 seals opening 90. In other embodiments of the invention, elongated portion 40 may or may not extend into container portion 82.

It should be noted that as elongated portion 40 is inserted into tube 84, elongated portion 40 substantially clears channel 92 of any caulking remaining therein. Specifically, the insertion of elongated portion 40 into tube member 84 forces the caulking back into the container portion 82 of cartridge 80. The removal of caulking from channel 92 combined with the seal formed between tube 84 and inner surface 26 of first member 12 prevents the caulking stored within cartridge 80 from contacting air. Thus, the caulking within cartridge 80 will remain usable for a longer period of time than if cap 10 were not employed.

Once cap 10 has been placed on tube 84, cartridge 80 may be stored on a nail, hook or other structure (not shown) by suspending cartridge 80 from ring 70. To later use the caulking within cartridge 80, cap 10 must be removed from tube 84. To remove cap 10 from cartridge 80, cap 10 may be pulled away from cartridge 80 by using ring 70 and/or planar member 42 as a handle. Member 12 may be twisted while removing cap 10 to assist in breaking the seal between member 12 and tube 84, as indicated by arrow "B." It should be noted that as elongated portion 40 is withdrawn from channel 92 shoulders 64 will scrape the inner surface of channel 92 and remove excess caulking within channel 92.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A cap configured to substantially seal an opening formed in a tube connected to a container, the cap comprising:

a first member including an interior defined by an interior surface and an opening;

a second member at least partially located in the interior of the first member, and readily movable relative to the first member, and the second member includes means for clearing the tube including a conical point on an end of the second member; and means for providing a grip when removing the cap from the tube, and wherein when the second member is fully inserted in the first member, an end of the second member opposite the means extends beyond the first member.

2. The cap as set forth in claim 1 wherein the means for providing a grip includes at least one planar member connected to the second member.

3. The cap as set forth in claim 2 further including a ring connected to the second member.

4. The cap as set forth in claim 3 wherein at least a portion of the planar member is located between the ring and the second member.

5. The cap as set forth in claim 1 wherein the second member has a length greater than the length of the interior of the first member.

6. The cap as set forth in claim 1 wherein the first member has a shape of a frustum.

7. The cap as set forth in claim 1 wherein the means for clearing the tube includes a plurality of shoulders.

8. The cap as set forth in claim 7 wherein each of the shoulders is positioned proximate at least one tapered portion and cylindrical portions extend between the shoulders with the shoulders including a ledge extending perpendicularly into the cylindrical portions.

* * * * *